US008998375B2

(12) United States Patent
Amma et al.

(10) Patent No.: US 8,998,375 B2
(45) Date of Patent: Apr. 7, 2015

(54) LIQUID EJECTION APPARATUS AND LIQUID EJECTION HEAD

(71) Applicant: Canon Kabushiki Kaisha, Tokyo (JP)

(72) Inventors: Hiromasa Amma, Kawasaki (JP); Kyosuke Toda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/258,208

(22) Filed: Apr. 22, 2014

(65) Prior Publication Data

US 2014/0333695 A1 Nov. 13, 2014

(30) Foreign Application Priority Data

May 13, 2013 (JP) ..... 2013-101314

(51) Int. Cl.

| | |
|---|---|
| ***B41J 2/015*** | (2006.01) |
| ***B41J 2/05*** | (2006.01) |
| ***B41J 2/175*** | (2006.01) |
| ***B41J 2/04*** | (2006.01) |

(52) U.S. Cl.

CPC ..... *B41J 2/04* (2013.01)

(58) Field of Classification Search

CPC ..... B41J 2/01; B41J 2/1404; B41J 2/1631; B41J 2/1603; B41J 2/1639; B41J 2202/11; B41J 1/175; B41J 2/17596; B41J 2/17509; B41J 2/18; B41J 2/17513; C09D 11/322; C09D 11/30; C09D 11/38; C09D 11/101

See application file for complete search history.

(56) References Cited

U.S. PATENT DOCUMENTS

| | | | |
|---|---|---|---|
| 7,267,431 | B2 | 9/2007 | Anderson et al. |
| 2014/0240409 | A1 * | 8/2014 | Watanabe et al. ..... 347/85 |

FOREIGN PATENT DOCUMENTS

| | | | |
|---|---|---|---|
| JP | 2008-238518 | A | 10/2008 |

* cited by examiner

*Primary Examiner* — Lisa M Solomon

(74) *Attorney, Agent, or Firm* — Fitzpatrick, Cella, Harper & Scinto

(57) ABSTRACT

A liquid ejection head includes a recording element substrate provided with elements formed on one surface of the substrate for generating energy for ejecting liquid as well as first and second supply ports each piercing between both surfaces of the substrate for supplying the liquid to the elements; and a support member provided with first and second liquid storage portions, first and second communication paths that respectively allow the first and the second supply ports to communicate with the first and second liquid storage portions, the support member supporting the other surface of the substrate. The length of the first communication path is longer than that of the second communication path. The horizontal cross-sectional area of the first communication path in a direction perpendicular to the liquid supply direction is larger than that of the second communication path.

11 Claims, 11 Drawing Sheets

LIQUID EJECTION APPARATUS AND LIQUID EJECTION HEAD

BACKGROUND OF THE INVENTION

1. Field of the Invention

The present invention relates to a liquid ejection apparatus in which a liquid ejection head having a liquid storage portion provided in a support member supporting a recording element substrate is mounted, and a liquid ejection head detachably mounted in a liquid ejection apparatus.

2. Description of the Related Art

A liquid ejection head with a plurality of liquid storage portions provided in a support member supporting a recording element substrate has been proposed (U.S. Pat. No. 7,267,431). A liquid ejection apparatus in which a liquid ejection head provided with a recording element substrate of a thermal system is mounted is described.

The recording element substrate has an ejection orifice formed in one surface of the recording element substrate, a bubbling chamber communicating with the ejection orifice, a heating resistor provided on a wall of the bubbling chamber as an ejection-energy-generating element and a plurality of liquid chambers communicating with the bubbling chamber. Each of the plural liquid chambers has an opening formed in another surface of the recording element substrate.

The support member supports said another surface. In addition, the support member has a communication path extending from the liquid storage portion to the opening of the liquid chamber. The liquid ejection head provided with the recording element substrate and the support member is mounted in the liquid ejection apparatus with the ejection orifice directed downward.

A liquid flows through the communication path and the liquid chamber in this order from the liquid storage portion to be supplied to the bubbling chamber. Film boiling is caused in the liquid within the bubbling chamber by applying drive energy to the heating resistor. The liquid is ejected from the ejection orifice by using a pressure by the film boiling.

The recording element substrate contains a relatively expensive member. In order to reduce the cost of the liquid ejection head or the liquid ejection apparatus, there is a demand for miniaturizing the recording element substrate.

For example, the recording element substrate of the thermal system contains a semiconductor substrate for forming a heating resistor and an electrical wiring electrically connected to the heating resistor. The semiconductor substrate is obtained by dividing a silicon wafer into several pieces. The silicon wafer is a disc-like plate obtained by slicing a columnar ingot grown from a seed crystal of a semiconductor material such as silicon into a predetermined thickness and is a relatively expensive member.

The semiconductor substrate can be miniaturized by miniaturizing the recording element substrate. As a result, a greater number of semiconductor substrates are obtained from one silicon wafer. In other words, the recording element substrate is miniaturized, whereby a greater number of recording element substrates are prepared from one silicon wafer to reduce the cost of the liquid ejection head or the liquid ejection apparatus.

In order to miniaturize the recording element substrate containing the plural liquid chambers, it is effective to narrow a distance between adjoining liquid chambers. In a liquid ejection head having a plurality of communication paths, it is necessary to narrow even a distance between adjoining communication paths with narrowing distance between the adjoining liquid chambers. In order to narrow the distance between the adjoining communication paths, it is considered to thin a communication path wall between the adjoining communication paths.

However, the support member having the liquid storage portion is larger than the recording element substrate. Therefore, it is desirable to mold the support member with a material cheaper and weaker than the material of the recording element substrate, such as, for example, a resin material for reducing the cost of the support member. In the case of a support member formed of a resin material, the strength of the communication path wall is insufficient when the communication path wall is thinned, whereby there is a possibility that the communication path wall may be broken upon the production of the liquid ejection head or use thereof.

In the liquid ejection head disclosed in Japanese Patent Application Laid-Open No. 2008-238518, a horizontal cross-sectional area (an area of a section when a certain substance is cut along a horizontal surface; the same shall apply to the following) of the communication path is made smaller than the area of the opening of the liquid chamber or the horizontal cross-sectional area of the liquid storage portion for such a reason. The horizontal cross-sectional area of the communication path is made smaller, whereby the thickness of the communication path wall is thickened to ensure the strength of the communication path wall.

In a liquid ejection head having plural liquid storage portions, it is desirable for the plural liquid storage portions to have different lengths (a dimension regarding liquid flow direction; the same applies hereafter) in such a manner that the liquid storage portions can be provided at relatively free positions. The plural communication paths have different lengths, whereby the plural liquid storage portions can be provided at different positions in a vertical direction.

However, when the plural communication paths in the liquid ejection head disclosed in U.S. Pat. No. 7,267,431 have different lengths, there is a possibility that a liquid may not be successfully ejected from an ejection orifice communicating with a relatively long communication path. The reason for this is described with reference to FIGS. 14A and 14B. FIGS. 14A and 14B are sectional views illustrating a liquid ejection head having a plurality of communication paths different in length from one another.

A bubble grows in a space formed of a liquid storage portion 1*a*, 1*b* or 1*c*, a communication path 2*a*, 2*b* or 2*c* and a liquid chamber 3*a*, 3*b* or 3*c*. This bubble is considered to be caused by a gas remaining in a liquid, air flowing in together with the liquid when the liquid is poured into the liquid storage portion 1*a*, 1*b* or 1*c*, air flowing in from an ejection orifice upon ejection of the liquid and air flowing in from a space between a recording element substrate 4 and a support member 5.

Buoyancy and surface tension act on the bubble. The buoyancy is upward force caused by a water head difference between an upper portion and a lower portion of the bubble. The surface tension is divided into downward force (hereinafter referred to as "upper surface tension") acting on the upper portion of the bubble and upward force (hereinafter referred to as "lower surface tension") acting on the lower portion of the bubble. In addition, the intensity of the surface tension depends on the surface area of the bubble, and it is known that the surface tension becomes higher as the surface area of the bubble becomes smaller.

In the liquid ejection head illustrated in FIGS. 14A and 14B, the horizontal cross-sectional area Wa of the communication path 2*a* is smaller than the area of the opening of the liquid chamber 3*a*. When a bubble 6*a* grows within the liquid chamber 3*a*, and the horizontal cross-sectional area of the bubble 6*a* becomes larger than the horizontal cross-sectional area Wa of the communication path 2*a*, only the upper portion of the bubble 6*a* thus enters the communication path 2*a*.

Since the surface area of the upper portion of the bubble 6*a* is smaller than the surface area of the lower portion of the bubble 6*a* at this stage, the upper surface tension Tua is higher than the lower surface tension Tla. When the upper surface tension Tua becomes equal to resultant force of the lower surface tension Tla and buoyancy Ba, the bubble 6*a* stops going up, and the lower portion of the bubble 6*a* stays in the liquid chamber 3*a* (see FIG. 14A).

The horizontal cross-sectional area Wb of the communication path 2*b* is smaller than the area of the opening of the liquid chamber 3*b*. When a bubble 6*b* grows within the liquid chamber 3*b*, and the horizontal cross-sectional area of the bubble 6*b* becomes larger than the horizontal cross-sectional area Wb of the communication path 2*b*, the lower portion of the bubble 6*b* thus stays in the liquid chamber 3*b*, like the bubble 6*a*.

FIG. 14B is a drawing illustrating a status that the bubbles 6*a* and 6*b* have further grown from the state illustrated in FIG. 14A. In the status illustrated in FIG. 14A, the upper portion of the bubble 6*b* staying in the communication path 2*b* and the liquid chamber 3*b* reaches the liquid storage portion 1*b*. Since the horizontal cross-sectional area of the liquid storage portion is larger than the horizontal cross-sectional area Wb of the communication path 2*b*, the surface area of the upper portion of the bubble 2*b* becomes larger than that in the status illustrated in FIG. 14A. As a result, the upper surface tension Tub becomes lower than the resultant force of the lower surface tension Tlb and buoyancy Bb, and so the bubble 6*b* rises and gets out of the liquid chamber 3*b*.

Since the length La of the communication path 2*a* is longer than the length Lb of the communication path 2*b*, the upper portion of the bubble 6*a* does not reach the liquid storage portion 1*a* even when the bubble 6*a* has grown to the same extent as in the bubble 6*b*. Therefore, the upper surface tension Tua remains higher than the resultant force of the lower surface tension Tla and the buoyancy Ba, and so the lower portion of the bubble 6*a* continues to stay in the liquid chamber 3*a*.

The grown bubble 6*a* hinders the flowing of the liquid to the liquid chamber 3*a* from the liquid storage portion 1*a* to incur insufficient supply of the liquid into the liquid chamber 3*a*. As a result, the liquid is not successfully ejected from an ejection orifice communicating with the liquid chamber 3*a*.

For such a reason as described above, the liquid is not successfully ejected from the ejection orifice communicating with the relatively long communication path 2*a*.

There is a proposal that a suction mechanism for sucking the bubble 6*a* together with the liquid in the liquid chamber 3*a* from the ejection orifice is provided in the liquid ejection apparatus for removing the bubble 6*a* in the liquid chamber 3*a* (Japanese Patent Application Laid-Open No. 2008-238518). When the suction mechanism is provided in the liquid ejection apparatus, however, the cost of the liquid ejection apparatus is increased.

SUMMARY OF THE INVENTION

According to the present invention, there is provided a liquid ejection apparatus in which a liquid ejection head provided with a recording element substrate having an ejection orifice formed in one surface of the recording element substrate as well as a first liquid chamber and a second liquid chamber communicating with the ejection orifice and with a support member supporting the other surface of the recording element substrate is mounted with the ejection orifice directed downward, wherein each of the first and second liquid chambers has an opening formed in the other surface, the support member has a first storage portion, a second liquid storage portion, a first communication path extending from the first liquid storage portion to the opening of the first liquid chamber and a second communication path extending from the second liquid storage portion to the opening of the second liquid chamber, each of the first and second communication paths contains a flow path portion having a horizontal cross-sectional area smaller than the areas of the openings of the first and second liquid chambers, the flow path portion is connected to each of the first and second liquid storage portions in such a manner that an interior space of the liquid storage portion is narrowed down, wherein a length of the flow path portion of the first communication path is longer than a length of the flow path portion of the second communication path, and the first liquid storage portion is more distant from the recording element substrate than the second liquid storage portion, and wherein the horizontal cross-sectional area of the flow path portion of the first communication path is larger than the horizontal cross-sectional area of the flow path portion of the second communication path. According to the present invention, there is also provided a liquid ejection head comprising: a recording element substrate provided with an element formed on one surface of the recording element substrate for generating energy to be utilized for ejecting a liquid, and a first supply port and a second supply port each piercing between the one surface and the other surface of the recording element substrate for supplying the liquid to the element; a support member provided with a first liquid storage portion and a second liquid storage portion capable of storing the liquid, a first communication path that allows the first supply port to communicate with the first liquid storage portion, and a second communication path that allows the second supply port to communicate with the second liquid storage portion, the support member supporting the other surface of the recording element substrate, wherein a length of the first communication path is longer than a length of the second communication path, and a horizontal cross-sectional area of the first communication path in a direction perpendicular to a supply direction of the liquid is larger than a horizontal cross-sectional area of the second communication path.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
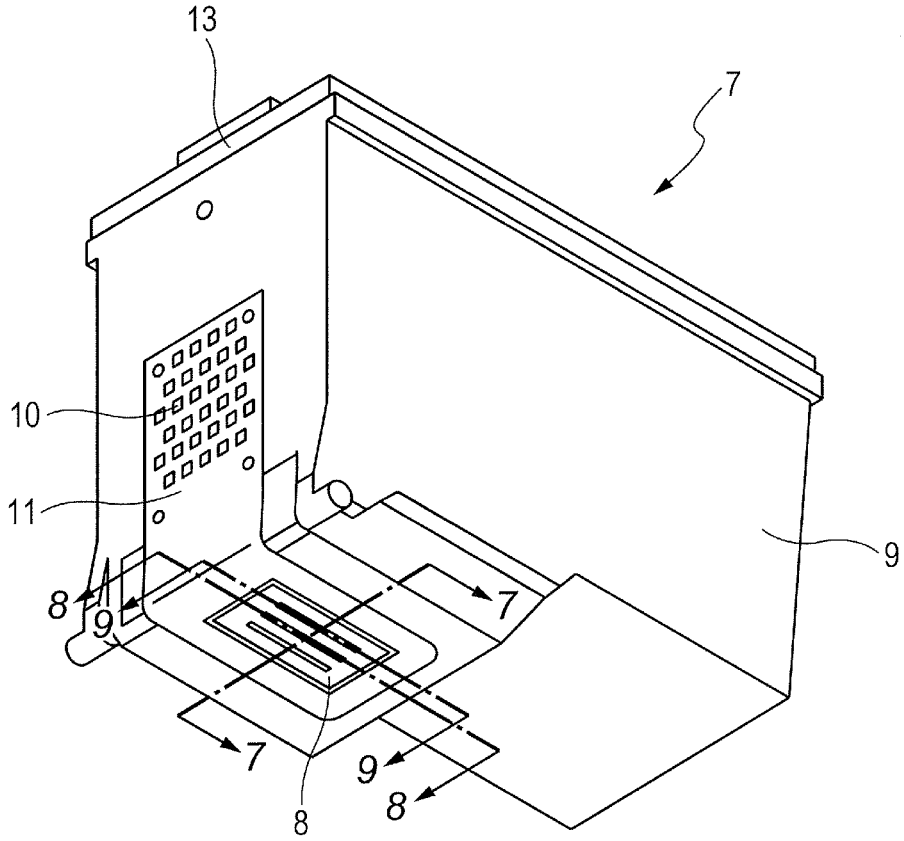
FIG. 1 is a perspective view illustrating a liquid ejection head according to an embodiment of the present invention when viewed from below.
Figure 2:
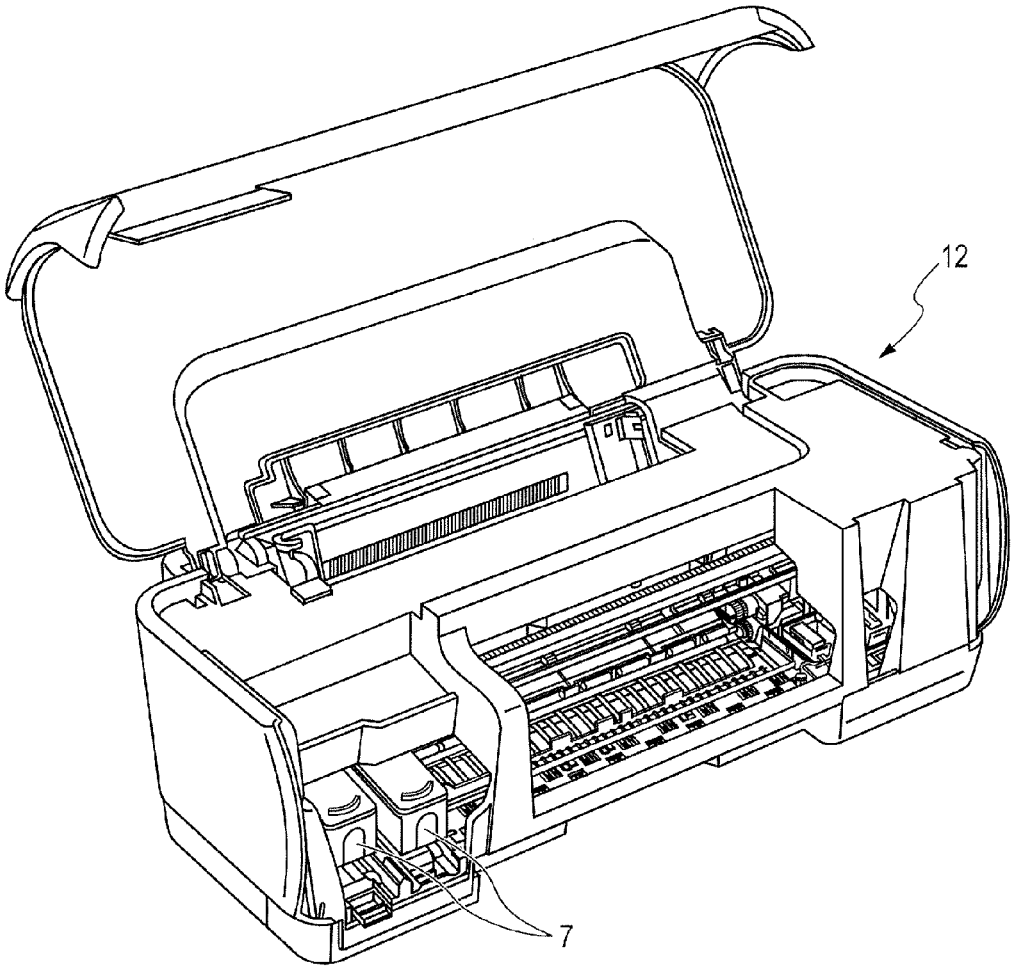
FIG. 2 is a perspective view illustrating a liquid ejection apparatus in which a liquid ejection head is mounted.

FIG. 1 is a perspective view illustrating a liquid ejection head according to an embodiment of the present invention when viewed from below, and FIG. 2 is a perspective view illustrating a liquid ejection apparatus in which the liquid ejection head is mounted.

As illustrated in FIG. 1, a liquid ejection head 7 according to this embodiment is provided with a recording element substrate 8, a support member 9 supporting the recording element substrate 8 and a contact portion 10 arranged on a side surface of the support member 9. The contact portion 10 is electrically connected to the recording element substrate 8 through an electrical wiring member (electrical wiring tape) 11.

A liquid ejection apparatus 12 (see FIG. 2) is provided with a carriage (not illustrated) detachably holding the liquid ejection head 7. When the liquid ejection head 7 is mounted in the liquid ejection apparatus 12, a contact pin (not illustrated) of the liquid ejection apparatus 12 comes into contact with the contact portion 10. A drive signal generated from the liquid ejection apparatus is transmitted to the recording element substrate 8 through the contact portion 10 and the electrical wiring member 11.

Figure 3:
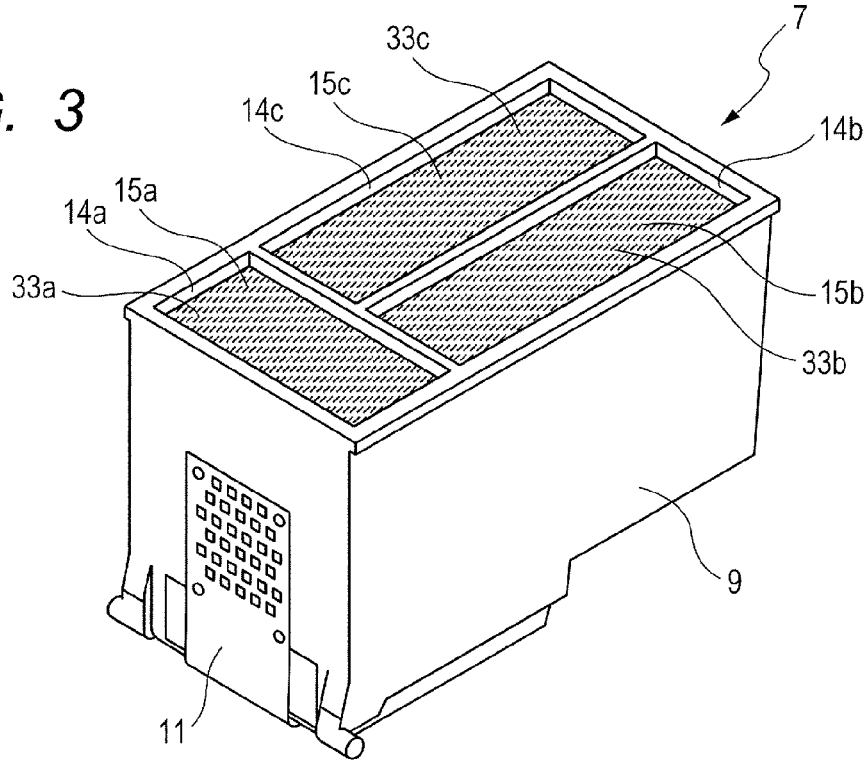
FIG. 3 is a perspective view illustrating a liquid ejection head according to the embodiment when viewed from above.

In addition, the liquid ejection head 7 is provided with a lid member 13 installed on an upper end of the support member 9. FIG. 3 is a perspective view illustrating the liquid ejection head 7 in a situation that the lid member 13 has been removed from the support member 9 when viewed from above.

As illustrated in FIG. 3, the support member 9 has a plurality of liquid reservoir portions 33*a*, 33*b* and 33*c*.

In this embodiment, the plural liquid reservoir portions 33*a*, 33*b* and 33*c* are formed by dividing one reservoir space with walls. In addition, the liquid reservoir portions 33*a*, 33*b* and 33*c* respectively contain liquid absorbers 15*a*, 15*b* and 15*c* for holding a liquid, and cyan, magenta and yellow inks are respectively held in the liquid absorbers 15*a*, 15*b* and 15*c*.

Needless to say, liquids stored in the liquid reservoir portions 33*a*, 33*b* and 33*c* are not limited to inks, and the same kind of liquid may be stored in the liquid reservoir portions 33*a*, 33*b* and 33*c*. In addition, the liquid reservoir portions 33*a*, 33*b* and 33*c* may store the liquids without using the liquid absorbers 15*a*, 15*b* and 15*c*.

Figure 4:
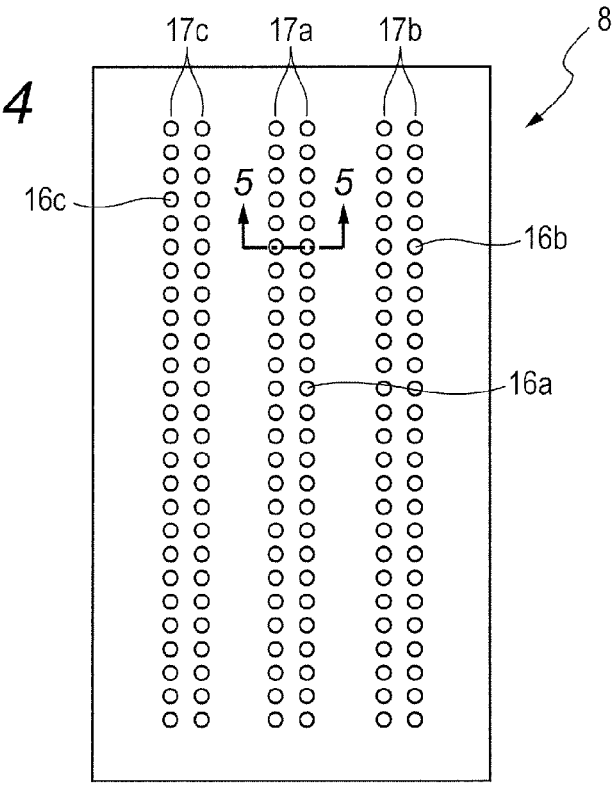
FIG. 4 is a plan view illustrating a recording element substrate.

FIG. 4 is a plan view illustrating the recording element substrate 8. As illustrated in FIG. 4, the recording element substrate 8 has three kinds of ejection orifices 16*a*, 16*b* and 16*c*, which respectively eject cyan, magenta and yellow inks. A plurality of the ejection orifices 16*a* are formed so as to form two ejection orifice arrays 17*a*. The ejection orifices 16*b* and 16*c* also form two ejection orifice arrays 17*b* and two ejection orifice arrays 17*c*, respectively, like the ejection orifices 16*a*.

Figure 5:
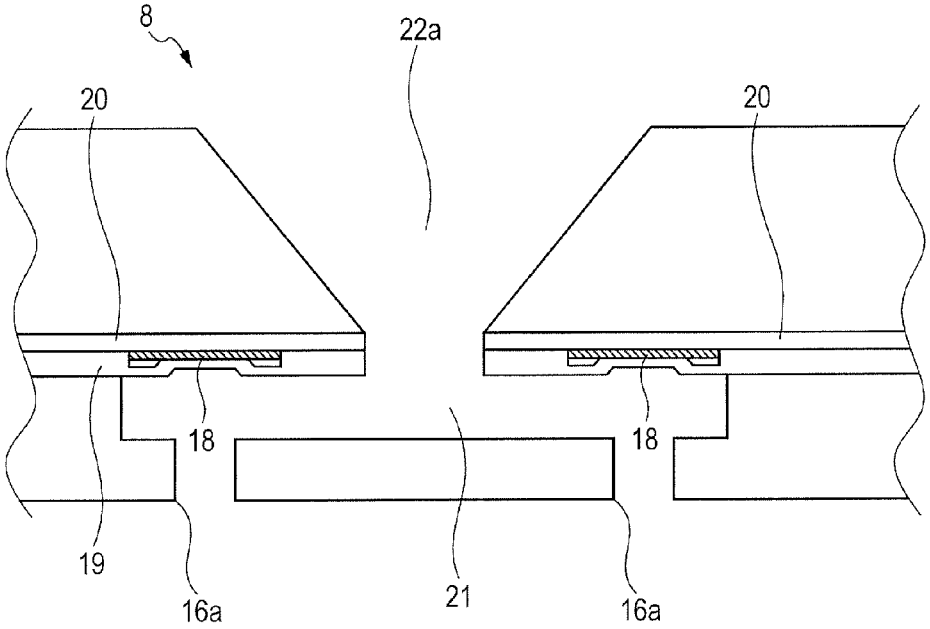
FIG. 5 is a sectional view of the recording element substrate taken along line 5-5 in FIG. 4.

FIG. 5 is a sectional view of the recording element substrate 8 taken along line 5-5 in FIG. 4. Incidentally, FIG. 5 illustrates only a periphery of the ejection orifice 16*a* for ejecting a magenta ink. However, peripheries of the ejection orifices 16*b* and 16*c* for respectively ejecting cyan and yellow inks also have the same structure as the periphery of the ejection orifice 16*a*.

As illustrated in FIG. 5, the recording element substrate 8 is provided with a heating resistor 18 as an ejection-energy-generating element for generating energy for ejecting a liquid. The heating resistor 18 is arranged at a position opposing the ejection orifice 16*a* and sandwiched between a protecting film 19 protecting the heating resistor 18 and an insulating film 20.

In addition, the recording element substrate 8 has a liquid chamber 22*a* communicating with the ejection orifice 16*a* through a flow path 21. The liquid chamber 22*a* has a supply port which is an opening formed in the other surface of the recording element substrate 8.

Figure 6:
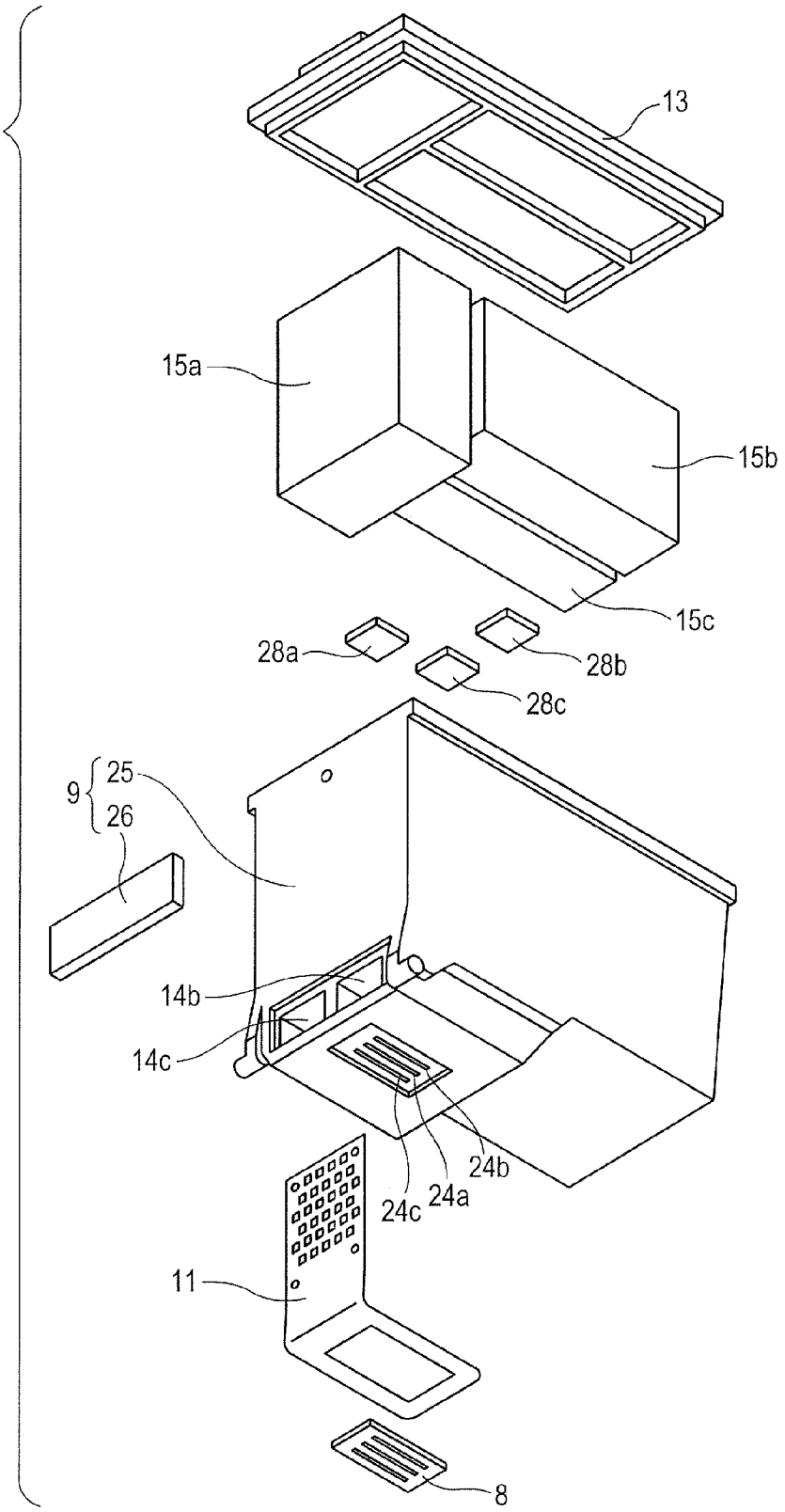
FIG. 6 is an exploded perspective view of the liquid ejection head.
Figure 7:
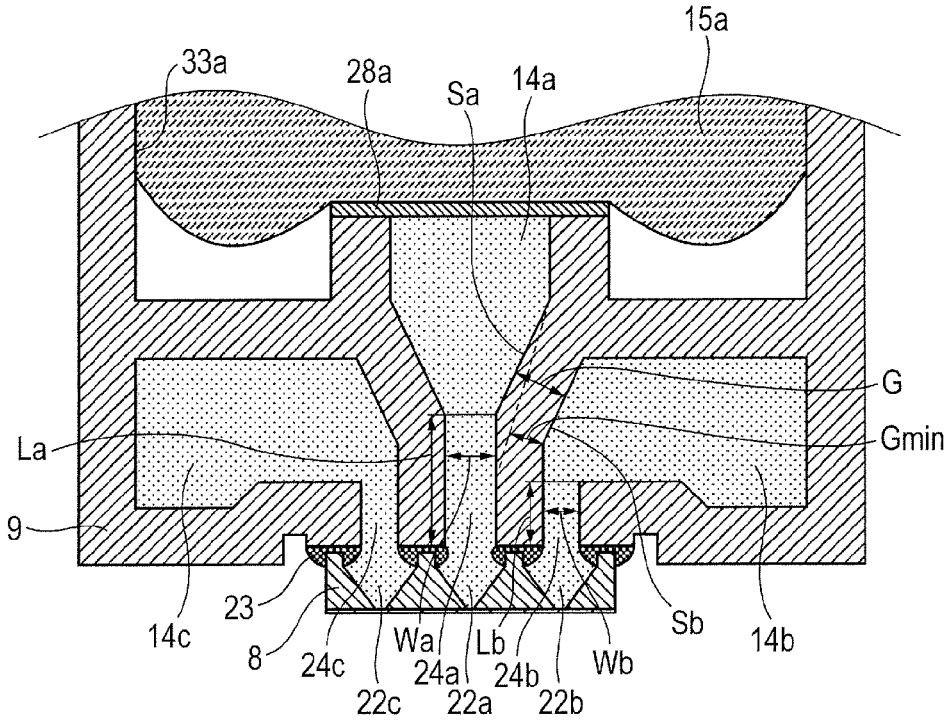
FIG. 7 is a sectional view of the liquid ejection head taken along line 7-7 in FIG. 1.
Figure 8:
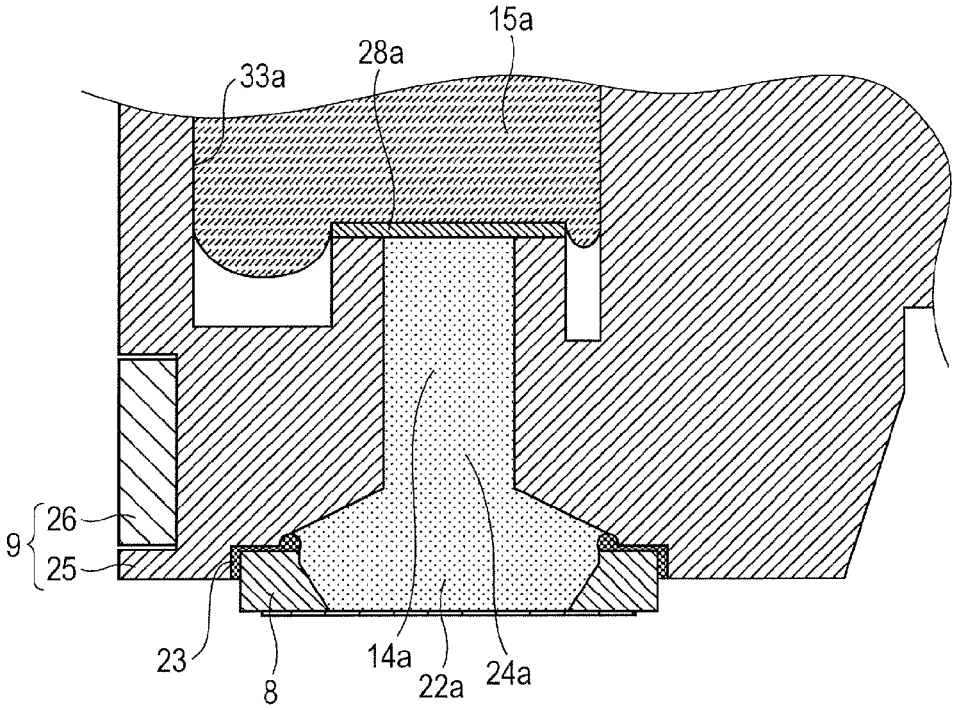
FIG. 8 is a sectional view of the liquid ejection head taken along line 8-8 in FIG. 1.
Figure 9:
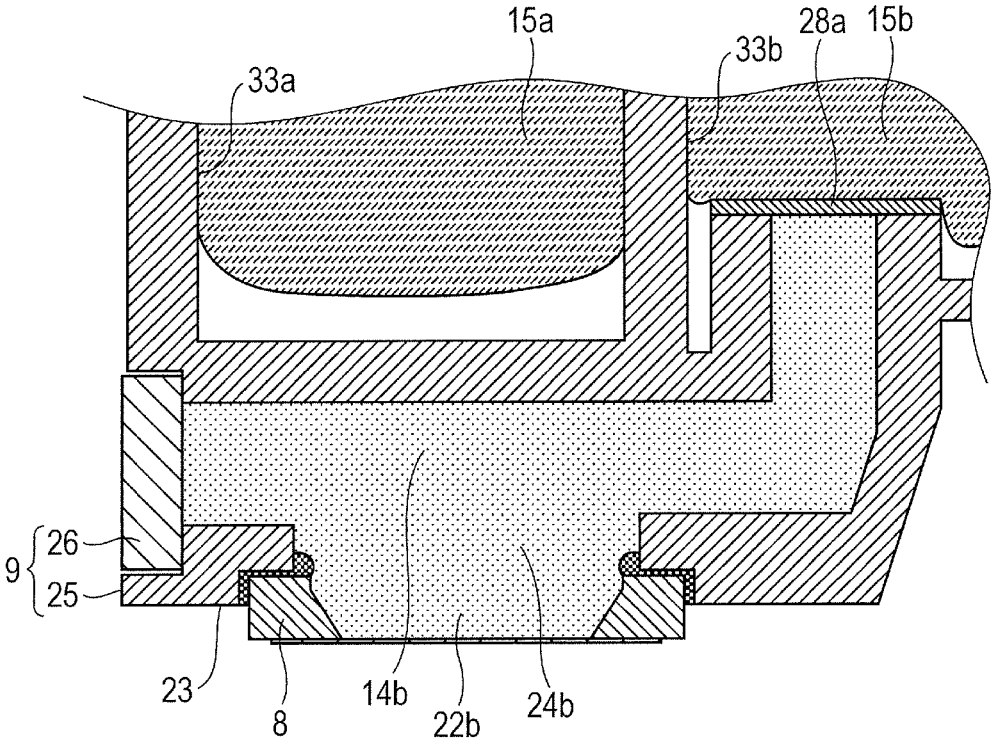
FIG. 9 is a sectional view of the liquid ejection head taken along line 9-9 in FIG. 1.

FIG. 6 is an exploded perspective view of the liquid ejection head 7. FIGS. 7 to 9 are sectional views of the liquid ejection head 7 respectively taken along line 7-7, line 8-8 and line 9-9 in FIG. 1. FIG. 9 illustrates a route of the liquid flowing from the liquid reservoir portion 33*b* to the liquid chamber 22*b* through the liquid storage portion 14*b*. However, a route of the liquid flowing from the liquid reservoir portion 33*c* to the liquid chamber 22*c* through the liquid storage portion 14*c* is also the same as the route illustrated in FIG. 9 and is omitted here.

As illustrated in FIGS. 7 to 9, the support member 9 supports another surface of the recording element substrate 8. Specifically, the other surface of the recording element substrate 8 is bonded to a lower surface of the support member 9 with an adhesive 23. The liquid storage portion 14*a* is located above the liquid chamber 22*a*, and the liquid reservoir portion 33*a* is located above that position. Like the liquid storage portion 14*a*, the liquid storage portion 14*b* is located above the liquid chamber 22*b*, and the liquid storage portion 14*c* is located above the liquid chamber 22*c*.

In addition, the support member 9 has a communication path 24*a* having a horizontal cross-sectional area smaller than the horizontal cross-sectional area of the liquid storage portion 14*a*. The communication path 24*a* extends from the liquid storage portion 14*a* to the liquid chamber 22*a* along a vertical direction and allows the liquid storage portion 14*a* to communicate with the liquid chamber 22*a*. Accordingly, the liquid in the liquid storage portion 14*a* flows in the order of the communication path 24*a* and liquid chamber 22*a* to be supplied to the ejection orifice 16*a* (see FIGS. 4 and 5). That is, the liquid stored in the liquid reservoir portion 33*a* is supplied to the liquid chamber 22*a* through the liquid storage portion 14*a* and the communication path 24*a* in this order. As illustrated in FIG. 7, an inner wall of the liquid storage portion 14*a* is tapered, and so the liquid storage portion 14*a* has a portion whose sectional area gradually decreases toward a joint portion to the first communication path 24*a*. As will be described below, a bubble within the communication path 24*a* easily exits to the liquid storage portion 14*a* by such a form.

Likewise, the support member 9 has a communication path 24*b* which allows the liquid storage portion 14*b* to communicate with the liquid chamber 22*b*, and a communication path 24*c* which allows communicating the liquid storage portion 14*c* to communicate with the liquid chamber 22*c*. The liquid in the liquid storage portion 14*b* flows in the order of the communication path 24*b* and liquid chamber 22*b* to be supplied to the ejection orifice 16*b* (see FIG. 4), and the liquid in the liquid storage portion 14*c* flows in order of the communication path 24*c* and liquid chamber 22*c* to be supplied to the ejection orifice 16*c* (see FIG. 4).

Incidentally, in the description of the present specification, the liquid storage portion 14*a*, the liquid chamber 22*a* and the communication path 24*a* may be referred to as the first liquid storage portion, the first liquid chamber and the first communication path, respectively. The liquid storage portion 14*b* or 14*c*, the liquid chamber 22*b* or 22*c* and the communication path 24*b* or 24*c* may be referred to as the second liquid storage portion, the second liquid chamber and the second communication path, respectively.

In this embodiment, as illustrated in FIGS. 6 and 9, the support member 9 contains first and second members 25 and 26 joined to each other. The liquid storage portion 14*a* and the communication paths 24*a*, 24*b* and 24*c* are formed only of the first member 25, and the liquid storage portions 14*b* and 14*c* are formed of the first member 25 and the second member 26.

The horizontal cross-sectional area of each of the communication paths 24*a*, 24*b* and 24*c* is smaller than the area of the opening of each of the liquid chambers 22*a*, 22*b* and 22*c*. Therefore, even when a distance between the liquid chambers 22*a* and 22*b* and a distance between the liquid chambers 22*a* and 22*c* are narrowed, a thickness of a communication path wall between the communication path 24*a* and the communication path 24*b* and a thickness of a communication path wall between the communication path 24*a* and the communication path 24*c* can be sufficiently ensured. Accordingly, the recording element substrate 8 can be miniaturized without impairing the strength of the communication path walls to reduce the costs of the liquid ejection head 7 and the liquid ejection apparatus 12 (see FIG. 2).

The length of the communication path 24*a* is longer than the length of the communication path 24*b* or 24*c*. Therefore, the liquid storage portions 14*a*, 14*b* and 14*c* can be provided at relatively free positions.

For example, when the length La of the communication path 24*a* and the length Lb of the communication path 24*b* are equalized to each other, a wall surface Sa of the liquid storage portion 14*a* has to be formed at a position of a dotted line illustrated in FIG. 7. In this case, a distance G between the wall surface Sa and a wall surface Sb of the liquid storage portion 14*b* narrows to Gmin. As a result, the strength of a storage portion wall between the liquid storage portion 14*a* and the liquid storage portion 14*b* is lowered. When a molding material is filled into a metal mold to mold the support member 9, it is difficult to fill a space to be the storage portion wall in the metal mold with the molding material.

In this embodiment, the length of the communication path 24*a* is longer than the length of the communication path 24*b* or 24*c*, so that the liquid storage portion 14*a* can be more separated from the recording element substrate 8 than the liquid storage portion 14*b* or 14*c*. As a result, the distance G between the wall surface Sa and the wall surface Sb can be widened to sufficiently ensure the strength of the storage portion wall. Even when the molding material is filled into the metal mold to mold the support member 9, it is easy to fill into the space to be the storage portion wall in the metal mold with the molding material.

Figure 10A:
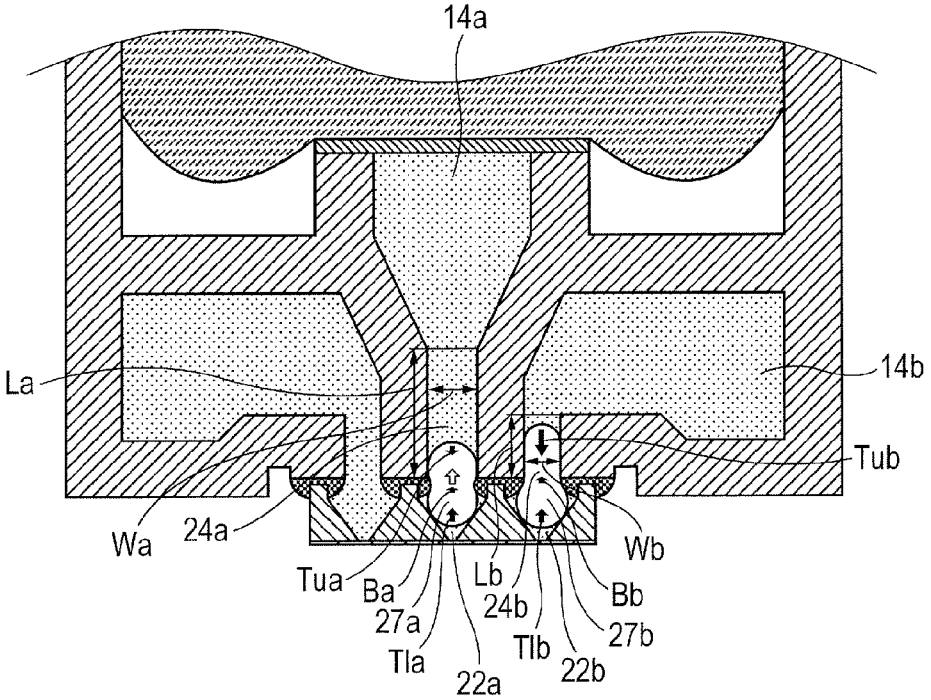
FIGS. 10A and 10B are sectional views taken along line 7-7 in FIG. 1 for explaining force acting on a bubble.
Figure 10B:
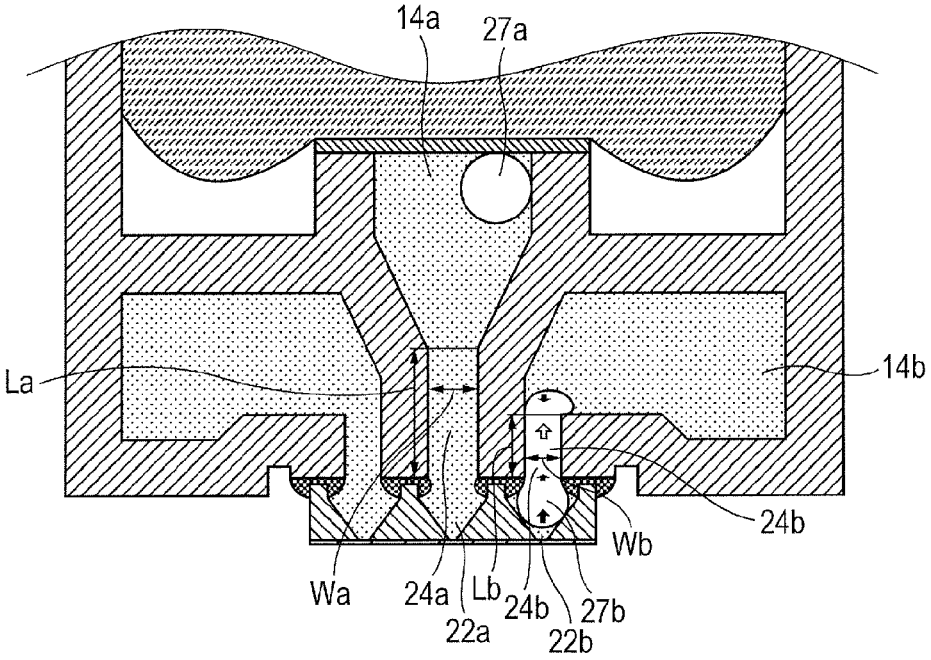

In addition, the horizontal cross-sectional area of the communication path 24*a* is larger than the horizontal cross-sectional area of the communication path 24*b* or 24*c*. Therefore, a bubble within the communication path 24*a* is more easily moved upward than a bubble within the communication path 24*b* or 24*c*. The reason for this is described with reference to FIGS. 10A and 10B. FIGS. 10A and 10B are sectional views of the liquid ejection head 7 taken along line 7-7 in FIG. 1 for explaining force acting on a bubble.

The horizontal cross-sectional area Wb of the communication path 24*b* is smaller than the area of the opening of the liquid chamber 22*b*. Therefore, a bubble 27*b* grown in the liquid chamber 22*b* so that the horizontal cross-sectional area of the bubble 27*b* has become larger than the horizontal cross-sectional area Wb of the communication path 24*b* rises owing to buoyancy Bb, whereby only an upper portion of the bubble 27*b* enters the communication path 24*b*, and a lower portion of the bubble 27*b* remains in the liquid chamber 22*b*.

Since the surface area of the upper portion of the bubble 27*b* is smaller than the surface area of the lower portion of the bubble 27*b* at this stage, the upper surface tension Tub is higher than the lower surface tension Tlb. When the upper surface tension Tub is equal to the resultant force of the lower surface tension Tlb and the buoyancy Bb, the bubble 27*b* does not rise, and the lower portion of the bubble 27*b* stays in the liquid chamber 22*b* (see FIG. 10A).

When the bubble 27*b* further grows, the upper portion of the bubble 27*b* reaches the liquid storage portion 14*b* as illustrated in FIG. 10B. Since the horizontal cross-sectional area of the liquid storage portion 14*b* is larger than the horizontal cross-sectional area Wb of the communication path 24*b*, the surface area of the upper portion of the bubble 27*b* becomes larger than that in the status illustrated in FIG. 10A. As a result, the upper surface tension Tub becomes lower than the resultant force of the lower surface tension Tlb and the buoyancy Bb, and so the bubble 27*b* rises and gets out of the liquid chamber 22*b*.

As illustrated in FIG. 10A, a bubble 27*a* grows even in the liquid chamber 22*a* like the bubble 27*b*. Since the length La of the communication path 24*a* is longer than the length Lb of the communication path 24*b*, an upper portion of the bubble 27*a* does not reach the liquid storage portion 14*a* even when the bubble 27*a* grows to the same extent as the bubble 27*b*.

Since the horizontal cross-sectional area Wa of the communication path 24*a* is larger than the horizontal cross-sectional area Wb of the communication path 24*b*, the upper surface tension Tua of the bubble 27*a* is lower than the lower surface tension Tub of the bubble 27*b*. Accordingly, the upper surface tension Tua is apt to become lower than the resultant force of the lower surface tension Tla and the buoyancy Ba, and so the bubble 27*a* rises even when the upper portion of the bubble 27*a* does not reach the liquid storage portion 14*a*. As a result, the bubble 27*a* gets out of the liquid chamber 22*a*.

Since the grown bubbles 27*a* and 22*b* do not stay in the respective liquid chambers 22*a* and 22*b*, liquids are sufficiently supplied to the liquid chambers 22*a* and 22*b*, respectively, from the liquid storage portions 14*a* and 14*b*. As a result, the liquids can be successfully ejected from the ejection orifices 16*a* and 16*b* (see FIGS. 4 and 5) respectively communicating with the liquid chambers 22*a* and 22*b*.

The length and horizontal cross-sectional area of the communication path 24*c* are equal to the length and horizontal cross-sectional area of the communication path 24*b*, and so a bubble grown in the liquid chamber 22*c* is hard to stay.

Incidentally, in this embodiment, the widths of the communication path 24*a* and the communication path 24*b* illustrated in FIGS. 8 and 9 are made equal to each other, and the width of the communication path 24*a* is made larger than the width of the communication path 24*b* as illustrated in FIG. 7, whereby the horizontal cross-sectional area of the communication path 24*a* is made larger than the horizontal cross-sectional area of the communication path 24*b*. In FIG. 7 and FIGS. 10A and 10B, the horizontal cross-sectional areas Wa and Wb are one-dimensionally illustrated for convenience's sake.

Incidentally, the liquid ejection head 7 according to this embodiment has the communication paths 24*b* and 24*c* as relatively short second communication paths and the communication path 24*a* arranged between the communication paths 24*b* and 24*c* as a relatively long first communication path. However, the present invention is not limited to this mode. For example, the number of the second communications paths may be one, or three or more. In addition, the first communication path may not be located between the two second communication paths.

In addition, in this embodiment, the liquid chamber 22*a* is formed in such a manner that a distance between inner side faces opposing each other in a horizontal direction becomes narrower downward. The liquid chambers 22*b* and 22*c* also have the same form as the liquid chamber 22*a*. The liquid chambers 22*a*, 22*b* and 22*c* are formed in such a form, whereby liquids in the liquid chambers 22*a*, 22*b* and 22*c* are easily supplied to the ejection orifices 16*a*, 16*b* and 16*c* (see FIGS. 4 and 5), respectively. As a result, the liquids can be successfully ejected respectively from the ejection orifices 16*a*, 16*b* and 16*c*.

When the liquid chamber 22*a* is formed in such a manner that the distance between the inner side faces opposing each other in the horizontal direction becomes narrower downward, the horizontal cross-sectional area Wa of the communication path 24*a* is desirably not smaller than the horizontal cross-sectional area of an imaginary sphere inscribed with the liquid chamber 22*a*. Incidentally, the term "imaginary sphere inscribed with the liquid chamber 22*a*" as used herein means an imaginary sphere coming into contact with imaginary planes formed when two inner side faces of the liquid chamber 22*a* and the opening of the liquid chamber 22*a* are closed. In addition, the term "horizontal cross-sectional area of the imaginary sphere" means an area of a section when the imaginary sphere is cut along an imaginary plane passing through the center of the imaginary sphere.

By such a configuration, the upper surface tension Tua is constantly not higher than the upper surface tension Tub of the bubble 27*b*. Accordingly, the upper surface tension Tua is constantly lower than the resultant force of the lower surface tension Tla and the buoyancy Ba, and so the bubble 27*a* rises without staying in the liquid chamber 22*a*. As a result, ejection failure is more inhibited.

FIGS. 7 to 9 are again referred to. The liquid ejection head 7 may also be provided with filters 28*a*, 28*b* and 28*c* respectively stored in the liquid reservoir portions 33*a*, 33*b* and 33*c*. By providing the filters 28*a*, 28*b* and 28*c*, inflow of dust to the recording element substrate 8 through the filters 28*a*, 28*b* and 28*c* can be prevented.

The filter 28*a* is specifically described. A liquid absorber 15*a* is contained in only a part of the liquid reservoir portion 33*a*, and the filter 28*a* is arranged between the liquid absorber 15*a* and the communication path 24*a*. Since the liquid held in the liquid absorber 15*a* flows into the communication path 24*a* through the filter 28*a*, the dust is prevented from flowing into the communication path 24*a* from the liquid absorber 15*a*.

The support member 9 according to this embodiment can be produced by molding of first and second members 25 and 26 using a metal mold and joining of the first and second members 25 and 26 using an ultrasonic welding method. The production process of the support member 9 is described with reference to FIGS. 11 to 13.

Figure 11:
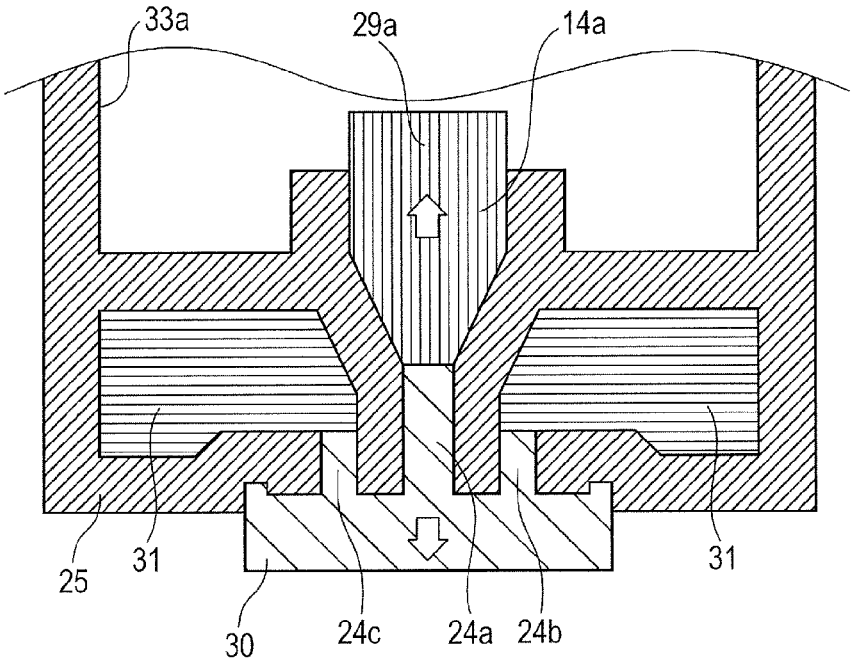
FIG. 11 is a sectional view taken along line 7-7 in FIG. 1 for explaining a production process of a support member.
Figure 12:
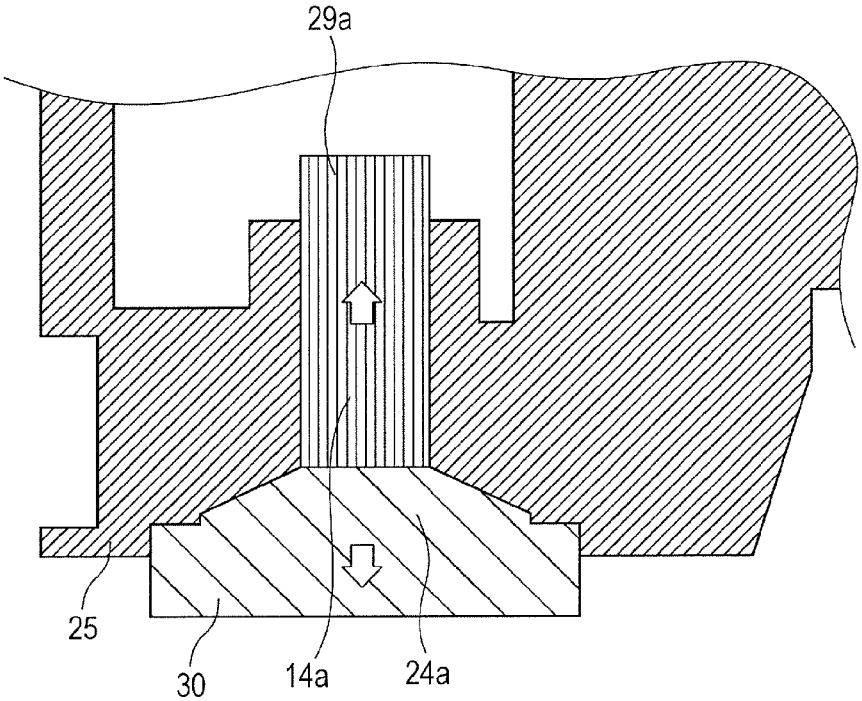
FIG. 12 is a sectional view taken along line 8-8 in FIG. 1 for explaining the production process of the support member.
Figure 13:
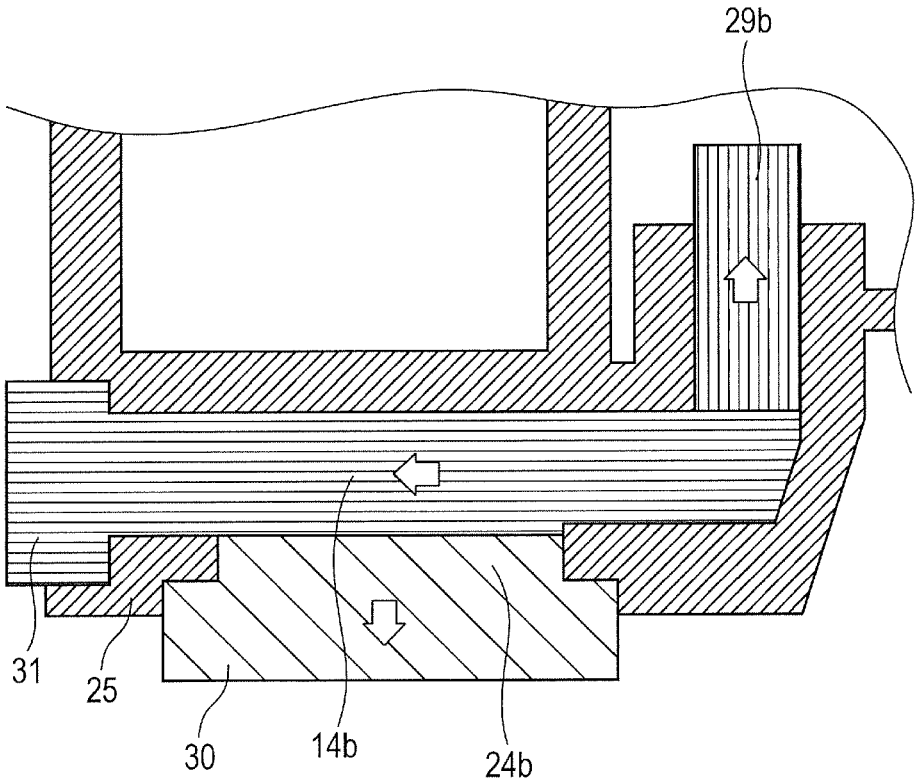
FIG. 13 is a sectional view taken along line 9-9 in FIG. 1 for explaining the production process of the support member.
Figure 14A:
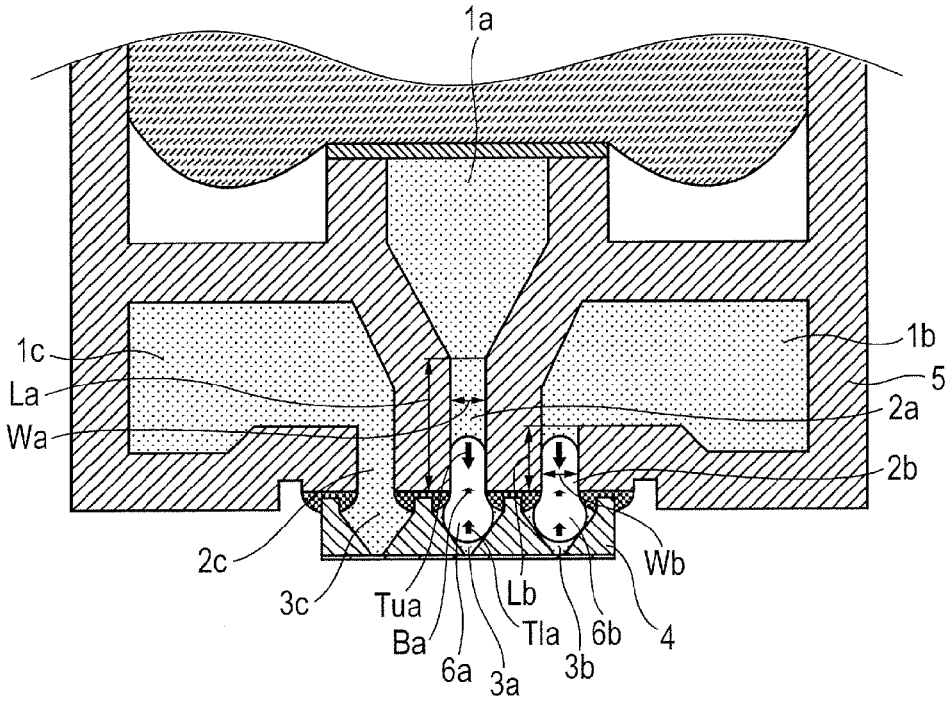
FIGS. 14A and 14B are sectional views of a liquid ejection head having a plurality of communication paths different in length.
Figure 14B:
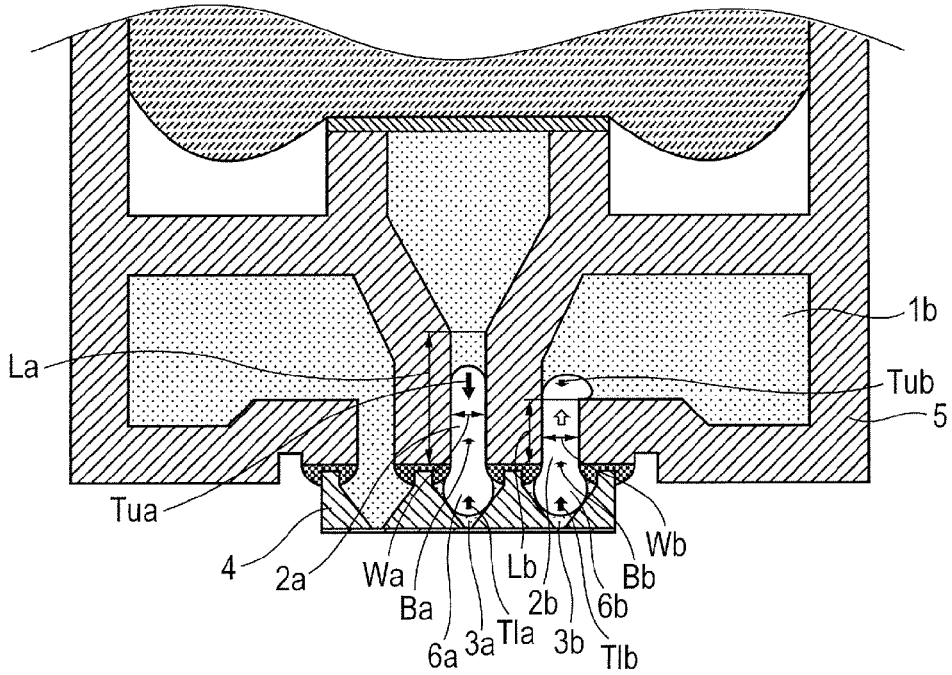

FIGS. 11 to 13 are drawings for illustrating an example of a process for molding the first member 25. Incidentally, the FIGS. 11 to 13 are sectional views of the first member 25 respectively taken along line 7-7, line 8-8 and line 9-9 in FIG. 1. FIG. 13 illustrates a periphery of the liquid storage portion 14*b*. However, a periphery of the liquid storage portion 14*c* also has the same structure as the periphery of the liquid storage portion 14*b*.

As illustrated in FIGS. 11 to 13, the first member 25 is molded by using a metal mold containing core pieces 29*a*, 29*b* and 29*c*, a cavity piece 30 and a slide piece 31. A molding material is filled into the metal mold, whereby the liquid storage portion 14*a* and the communication paths 24*a*, 24*b* and 24*c* are formed, and parts of the liquid storage portions 14*b* and 14*c* are formed.

Specifically, as illustrated in FIGS. 11 and 12, the core piece 29*a* and the cavity piece 30 are moved to directions of the void arrows in the drawings after the molding material is filled into the metal mold, whereby the liquid storage portion 14*a* and the communication paths 24*a*, 24*b* and 24*c* are formed. As illustrated in FIGS. 11 and 13, the core piece 29*b* and the slide piece 31 are moved to directions of the void arrows in the drawings after the molding material is filled into the metal mold, whereby the liquid storage portion 14*b* is formed. The liquid storage portion 14*c* is formed by using the core piece 29*c* and the slide piece 31 like the liquid storage portion 14*b*.

FIGS. 6 and 9 are again referred to. The second member 26 is joined to the first member 25 to form the liquid storage portions 14*b* and 14*c* together with the first member 25. Here, a method for joining the second member 26 to the first member 25 is described.

As example of the method for joining the second member 26 to the first member 25, an adhesive bonding method and an ultrasonic welding method are mentioned.

The adhesive bonding method is a method of joining the first and second members 25 and 26 to each other by applying an adhesive to at least one of the first and second members 25 and 26 and solidifying the adhesive while bringing one member into contact with the other member through the adhesive. In the adhesive bonding method, a joint surface may be relatively narrow. However, it takes a comparative cost because there is need to provide and solidify the adhesive.

The ultrasonic welding method is a method of welding the first and second members 25 and 26 to each other with frictional heat generated by rubbing the first and second members 25 and 26 with each other. In the ultrasonic welding method, the cost is low compared with the adhesive bonding method because there is no need to provide and solidify the adhesive. However, a wider joint surface is required because the first and second members 25 and 26 have to be rubbed with each other upon joining.

In this embodiment, the second member 26 is a member for forming the liquid storage portions 14*b* and 14*c* together with the first member 25. That is, a joint portion between the first member 25 and the second member 26 forms walls of the liquid storage portions 14*b* and 14*c*.

Since the thickness of the walls of the liquid storage portions 14*b* and 14*c* does not influence the size of the recording element substrate 8, the walls of the liquid storage portions 14*b* and 14*c* may be relatively thick. Accordingly, the joint surface 32 between the first member 25 and the second member 26 may be made relatively wide, and so the ultrasonic welding method may be used for the joint of the first member 25 to the second member 26. As a result, a cost required to join the second member 26 to the first member 25 is more reduced, and so the cost of the liquid ejection head 7 is reduced.

Incidentally, in the embodiment illustrated in FIGS. 7 and 10, the communication path 24*a* has a horizontal cross-sectional area Wa smaller than the area of the opening of the liquid chamber 22*a* over an overall region from the liquid storage portion 14*a* to the liquid chamber 22*a*. However, the present invention is not limited to this mode.

For example, the communication path 24*a* may also be formed of a small flow path portion having a horizontal cross-sectional area smaller than the area of the opening of the liquid chamber 22*a* and a large flow path portion having a horizontal cross-sectional area not smaller than the area of the opening of the liquid chamber 22*a*. The communication paths 24*b* and 24*c* may also have the same structure as the communication path 24*a*. In this case, it is only necessary to make the length of the small flow path portion in the communication path 24*a* longer than the length of the small flow path portion in the communication path 24*b* or 24*c* and make the horizontal cross-sectional area of the small flow path portion in the communication path 24*a* larger than the horizontal cross-sectional area of the small flow path portion in the communication path 24*b* or 24*c*.

When the communication paths 24*a*, 24*b* and 24*c* have the large flow path portion, there is a possibility that the communication path wall may be thinned, and so the strength thereof may be insufficient. In order to ensure the strength of the communication path wall, at least one of the communication paths 24*a*, 24*b* and 24*c* is more favorably formed of the small flow path portion alone. All the communication paths 24*a*, 24*b* and 24*c* are still more favorably formed of the small flow path portion alone.

The horizontal cross-sectional area of the liquid storage portion 14*a* may not be larger than the horizontal cross-sectional area of the communication path 24*a* over the whole of the liquid storage portion 14*a*. Specifically, it is only necessary for the horizontal cross-sectional area of a portion (lower portion) joined to the communication path 24*a* in the liquid storage portion 14*a* to be larger than the horizontal cross-sectional area of the communication path 24*a*. In other words, it is only necessary to connect the flow path portion of the communication path 24*a* to the liquid storage portion 14*a* in such a manner that an interior space of the liquid storage portion 14*a* is narrowed down. The communication paths 24*b* and 24*c* may also have the same structure as the communication path 24*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-101314, filed May 13, 2013, which is hereby incorporated by reference herein in its entirety.

What is claimed is:

1. A liquid ejection apparatus in which a liquid ejection head provided with a recording element substrate having ejection orifices formed in one surface of the recording element substrate as well as a first liquid chamber and a second liquid chambers respectively communicating with the ejection orifices and with a support member supporting the other surface of the recording element substrate is mounted with the ejection orifices directed downward, wherein each of the first and second liquid chambers has an opening formed in the other surface, the support member has a first liquid storage portion, a second liquid storage portion, a first communication path extending from the first liquid storage portion to the opening of the first liquid chamber and a second communication path extending from the second liquid storage portion to the opening of the second liquid chamber, each of the first and second communication paths contains a flow path portion having a horizontal cross-sectional area smaller than the areas of the openings of the first and second liquid chambers, each of the flow path portions being connected to one of the first and second liquid storage portions in such a manner that an interior space of each of the first and second liquid storage portions is narrowed down, wherein a length of the flow path portion of the first communication path is longer than a length of the flow path portion of the second communication path, and the first liquid storage portion is more distant from the recording element substrate than the second liquid storage portion, and wherein the horizontal cross-sectional area of the flow path portion of the first communication path is larger than the horizontal cross-sectional area of the flow path portion of the second communication path.

2. The liquid ejection apparatus according to claim 1, wherein the support member has two second communication paths, and the first communication path is located between the two second communication paths.

3. The liquid ejection apparatus according to claim 1, wherein the first liquid chamber is formed in such a manner that a distance between inner side faces opposing each other in a horizontal direction becomes narrower downward.

4. The liquid ejection apparatus according to claim 3, wherein the horizontal cross-sectional area of the flow path portion of the first communication path is not smaller than an area of a section obtained when an imaginary sphere inscribed with the first liquid chamber is cut along an imaginary plane passing through the center of the imaginary sphere.

5. The liquid ejection apparatus according to claim 1, wherein the support member contains a first member and a second member joined to each other, the first liquid storage portion and the first and second communication paths are formed only of the first member, and the second liquid storage portion is formed of the first member and the second member.

6. The liquid ejection apparatus according to claim 1, wherein at least one of the first and second communication paths is formed of the flow path portion alone.

7. A liquid ejection head comprising:

a recording element substrate provided with an elements formed on one surface of the recording element substrate for generating energy to be utilized for ejecting a liquid as well as a first supply port and a second supply port each piercing between the one surface and the other surface of the recording element substrate for supplying the liquid to the elements;

a support member provided with a first liquid storage portion and a second liquid storage portion capable of storing the liquid, a first communication path that allows the first supply port to communicate with the first liquid storage portion, and a second communication path that allows the second supply port to communicate with the second liquid storage portion, the support member supporting the other surface of the recording element substrate, wherein a length of the first communication path is longer than a length of the second communication path, and a horizontal cross-sectional area of the first communication path in a direction perpendicular to a supply direction of the liquid is larger than a horizontal cross-sectional area of the second communication path.

8. The liquid ejection head according to claim 7, wherein the support member has two second communication paths, and the first communication path is located between the two second communication paths.

9. The liquid ejection head according to claim 8, further comprising a first reservoir portion communicating with the first liquid storage portion and a second reservoir portion communicating with the second liquid storage portion.

10. The liquid ejection head according to claim 7, wherein a filter is arranged between the first liquid storage portion and the first reservoir portion and between the second liquid storage portion and the second reservoir portion.

11. The liquid ejection head according to claim 7, wherein the first liquid storage portion is provided with a portion whose sectional area gradually decreases toward a joint portion with the first communication path.

* * * * *